US012091830B2

(12) United States Patent
Saidel et al.

(10) Patent No.: US 12,091,830 B2
(45) Date of Patent: Sep. 17, 2024

(54) CONSTRUCTION METHOD AND DEVICE FOR EXECUTION OF A CAST IN-SITU PILE WITH MULTIPLE DIAMETERS DECREASING WITH DEPTH

(71) Applicant: Tudor Saidel, Bucharest (RO)

(72) Inventors: Tudor Saidel, Bucharest (RO); Cornel Mircea Valentin Radulescu, Bucharest (RO)

( * ) Notice: Subject to any disclaimer, the term of this patent is extended or adjusted under 35 U.S.C. 154(b) by 379 days.

(21) Appl. No.: 17/602,191

(22) PCT Filed: Apr. 8, 2020

(86) PCT No.: PCT/RO2020/050003
§ 371 (c)(1),
(2) Date: Oct. 7, 2021

(87) PCT Pub. No.: WO2020/209741
PCT Pub. Date: Oct. 15, 2020

(65) Prior Publication Data

US 2022/0145567 A1 May 12, 2022

(30) Foreign Application Priority Data

Apr. 8, 2019 (RO) ..... a 2019 00223

(51) Int. Cl.
*E02D 13/00* (2006.01)
*E02D 5/36* (2006.01)
(Continued)

(52) U.S. Cl.
CPC ..... *E02D 13/00* (2013.01); *E02D 5/36* (2013.01); *E02D 5/48* (2013.01); *E02D 15/04* (2013.01);
(Continued)

(58) Field of Classification Search
CPC combination set(s) only.
See application file for complete search history.

(56) References Cited

U.S. PATENT DOCUMENTS 3,604,214 A 9/1971 Turzillo
3,690,109 A 9/1972 Turzillo
(Continued)

FOREIGN PATENT DOCUMENTS

CN 102162248 B 8/2011
CN 104264666 A 1/2015
(Continued)

*Primary Examiner* — Kyle Armstrong
(74) *Attorney, Agent, or Firm* — Scheef & Stone, LLP; Robin L. Barnes

(57) ABSTRACT

This invention is detailing a construction method for a cast in-situ pile having an upper section with a larger diameter and at least one subsequent section with a smaller diameter, and a drilling device equipped with continuous flights which allows the construction of one pile having multiple diameters using the innovative construction method in a single continuous drilling phase while each drilling tool is penetrating through the soil in one pass.

Figure 1:
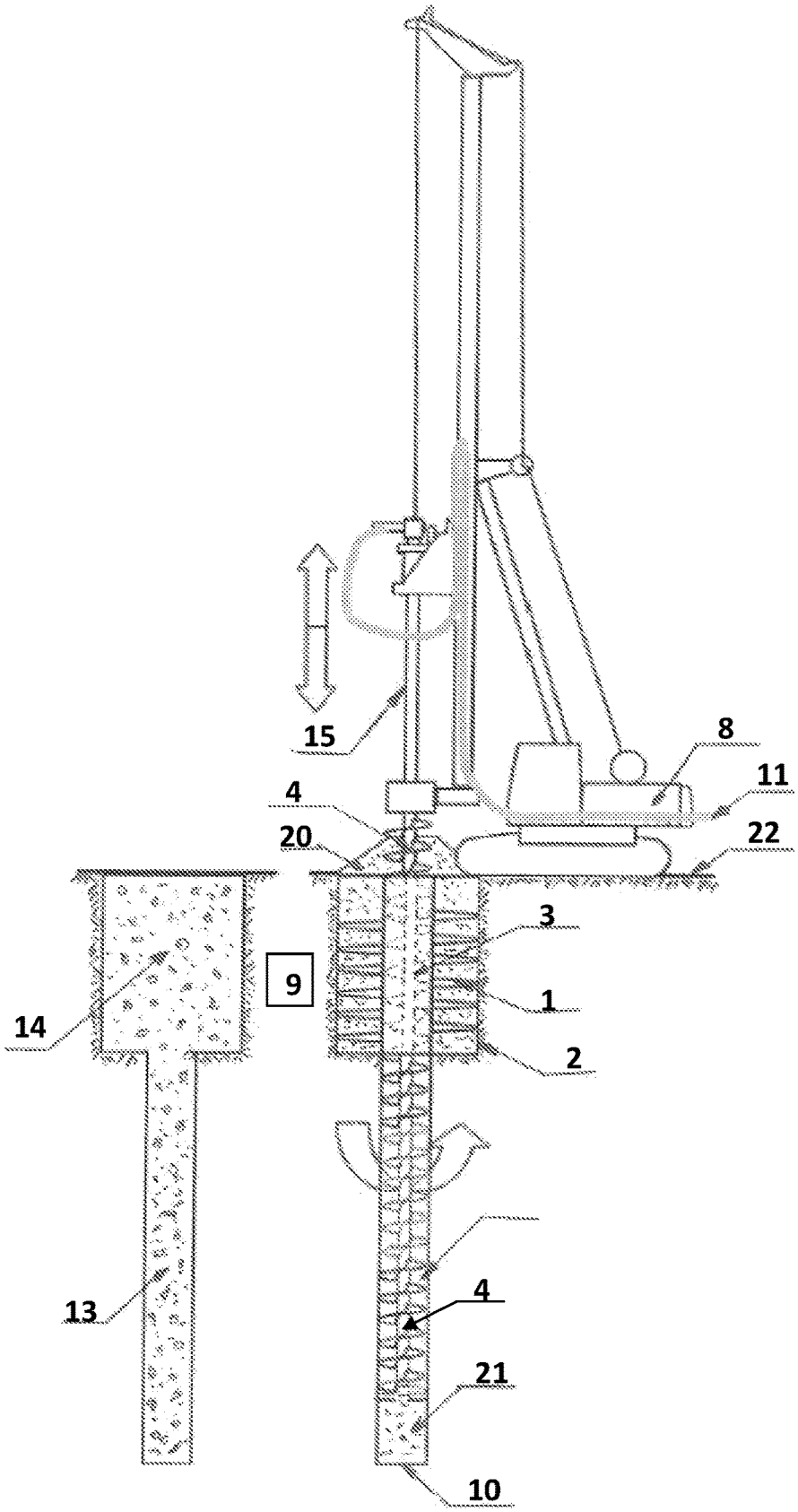

The drilling tool according to the invention has a central hollow space that allows accommodation through it of at least one another smaller diameter drilling tool that can drill continuously and can be coupled by means of a coupling-decoupling device in a specific manner to the other drilling tool in order to act as a fixed assembly, at any given position in relation to the smaller drilling tool length and rotating position.

9 Claims, 8 Drawing Sheets

(51) Int. Cl.

| | |
|---|---|
| ***E02D 5/48*** | (2006.01) |
| ***E02D 15/04*** | (2006.01) |
| ***E21B 7/00*** | (2006.01) |
| ***E21B 17/22*** | (2006.01) |

(52) U.S. Cl.
CPC ..... *E21B 7/002* (2013.01); *E21B 7/005* (2013.01); *E21B 17/22* (2013.01); *E02D 2250/0023* (2013.01); *E02D 2250/003* (2013.01); *E02D 2250/0038* (2013.01)

(56) References Cited

U.S. PATENT DOCUMENTS

| | | | | |
|---|---|---|---|---|
| 3,886,754 | A | 6/1975 | Turzillo | |
| 4,678,373 | A | 7/1987 | Langenbach, Jr. | |
| 9,624,638 | B2 * | 4/2017 | Lebreton | E02D 27/12 |
| 10,415,207 | B2 * | 9/2019 | Ditillo | E02D 5/36 |

FOREIGN PATENT DOCUMENTS

| | | | |
|---|---|---|---|
| CN | 106351213 | A | 1/2017 |
| CN | 108330959 | B | 7/2018 |
| CN | 109183831 | A | 1/2019 |
| EP | 0831180 | | 3/1998 |
| EP | 0937825 | | 8/1999 |
| EP | 1132525 | | 9/2001 |
| IE | 20010545 | | 12/2001 |

* cited by examiner

CONSTRUCTION METHOD AND DEVICE FOR EXECUTION OF A CAST IN-SITU PILE WITH MULTIPLE DIAMETERS DECREASING WITH DEPTH

Construction of many buildings used for civil, industrial or agricultural purpose, or infrastructure constructions like bridges or overcrossings involve foundations, meaning ways to transfer loads to the ground.

Choosing the foundation type and shape is depending on the structural system of the construction itself, on exploitation purpose of it, on existing ground conditions and on technical possibilities to construct. Chosen foundation solution must comply with safety regulations and structural design demands, allowing development of the entire project in a fast and economical manner.

Pile foundations are deep foundations which allow transfer of structural loads from superstructure to a good bearing strata of ground whether cohesive or non-cohesive soils, or even rock when shallow layers are unable to withstand the loads from the superstructure.

Cast in-situ piles are stiff elements, usually with circular cross section and vertical longitudinal axis.

These piles are often loaded on the top with large loads comprising of both axial and transversal loads as well as bending moments. Mostly due to necessity to withstand the transversal loads and bending moments applied on the pile heads, and in order to lower the displacements to acceptable values imposed by serviceability limits of many structures, is often needed a large cross section of the element, hence a large diameter of the piles.

Because the transversal loads and bending moments are decreasing along the depth of a pile, usually under 50% below a depth of 1.5 to 6 times the diameter of the pile, compared to the axial load which is decreasing slower in depth, it becomes more economical and therefore justified to reduce the diameter of the pile starting from a certain depth.

Sometimes is better to make piles with two reduction steps of diameter along the pile length. Such a case might be for example when large loads are transferred from the building structure and when the soil is improving progressively with depth its bearing and stiffness parameters. In such cases is technically and economically justified, for example, instead of making a pile with two diameters decreased in depth, upper pile length of 4 m having a 2 m diameter and remaining length of 15 m having a diameter of 1.2 m, to build a pile with three diameters, having following configuration: upper length of 4 m having a diameter of 2 m, next length of 8 m having a diameter of 1.2 m, and last section of 10 m having a diameter of 0.6 m. Therefore, sometimes is more advantageous that piles have a body with 2 or more diameters decreasing along the depth, where the upper section has a bigger diameter, and at least a following section having a smaller one. Moreover, execution of such a pile implies excavation of a smaller volume of displaced soil, less concrete and steel reinforcement is required, and piling rigs are inserting faster the drilling tools for smaller diameters, with less required energy and less wear on the tools, hence reducing the time needed for completion and amount of materials used while the built pile is fulfilling the technical parameters required by structural design. Among usual methods for construction of piles is the so called "intermittent drilling" using a telescopic Kelly bar, and the "continuous drilling" either by excavation of soil using a Continuous Flight Auger (CFA), or by displacement of the soil pushing it sideways and densification of surrounding soil by a special barrel tool.

Installation of piles using the CFA method has main advantage that stability of the borehole is insured by the excavated material that is partially transported to the surface by the auger flight, without need for other means to support the borehole walls, thus leading to a short time for completion. CFA construction method is often preferred for its simplicity, high productivity and economy in resources and materials needed for completion by other methods, such as for example water and bentonite used to prepare drilling mud used in various intermittent drilling methods. Construction of cast in-situ piles using full displacement through densification of surrounding soil has, compared to CFA method, also the advantage that by aforementioned densification the mechanical parameters of the soil are improved, increasing values for bearing capacity and stiffness of the pile. Densification method can be applied for various diameters and depths of the pile in soils with various properties, depending on the pushing force and torque capacities of the drilling rig that is used to operate the densifying tool, as well as depending on the shape and dimension of the drilling tool itself.

Usually, piles with variable diameter, reduced with depth, are made using the intermittent method using the telescopic Kelly bar and different drilling tools adequate to each diameter required.

Initially the first section of the shaft is made with a certain set of tools, then subsequently the drilling tools are replaced by other drilling sets which allow further drilling with a smaller diameter, and so on until final depth is reached. The method requires extraction of the drilling tool filled with a limited amount of excavated material repeatedly from the shaft, thus leading to a significant duration of the drilling time and subsequently to a low production rate. In most cases the drilled shaft is not stable and may collapse therefore ways to support the walls are required, such as use of temporary steel casing, or drilling slurry. These additional resources bring their own additional requirements such as need for special steel pipes with particular connections, or plants for preparation and conditioning of drilling slurry. Use of drilling slurries consumes significant amounts of raw materials such as clean water, bentonite or polymers, and finally disposal of the used slurry has a negative impact to the environment.

Moreover, often occurs cases where the drilling is made below the groundwater table, therefore Contractor concreting procedure is necessary, requiring use of tremie pipes and leading to a longer time in performance of the concreting operation. In conclusion, construction of piles with more diameters, decreasing in depth while using the current methods take time and consume significant resources such as manpower and fossil fuels due to low production rate for the drilling rigs which are used in the process.

EP0937825A2 discloses a construction method and a device used to enlarge the diameter of the upper section of piles made with CFA method, corresponding to the pile head. The method is consisting in the use of a tubular device, with a continuous outer wall, similar in shape to existing drilling buckets used in Kelly drilling, but having a central opening which allows insertion of a regular continuous flight auger through its core and having some couplings that allow the device to be fixed to the continuous flight auger and move together with the auger body. Main disadvantage of such device used for enlarging of the pile heads consists in the limited depth in the soil that can be achieved due to torque capacity of the drilling rig especially in conjunction to large diameters. Also possible length of upper section of a pile constructed this way is limited by the length of the tubular device, otherwise the borehole stability might be impaired.

Usually the ratio between length of a drilling bucket and its diameter is around two for drilling diameters below 1 m, and gradually decreasing to less than one for diameters exceeding 2 m. The mentioned lengths are mostly limited by difficulty to fill or empty the excavated material inside the body of the drilling bucket, especially in cohesive soils.

Another method and another device used for enlargement of pile heads is depicted in document IE200545A1. The device has the shape of a funnel, being preferably equipped with blades on the outer surface to ease soil penetration. The method consists in the execution of a ubiquitous CFA pile and in a subsequent stage enlargement of the pile head by use of the funnel shaped device applied over the existing shaft. As disadvantage is worth mentioning the dependence to mechanical resistance of the soil, in regards to depth and diameters that might be achieved by use of this method because might imply sometimes a significant consumption of energy and extended period of time related to amount of excavated soil.

Enlargement of pile upper sections, as depicted in documents EP 0937825A2 and IE200545A1, are made only for a somewhat shallow depth, on the pile heads, the obtained shape allowing only the pile reaction and capacity to withstand loads to be distributed over a larger surface of interaction between the pile itself and the upper structural element such as raft or beam, hence allowing only a slender design of the aforementioned upper elements. Due to depth limitations for the above mentioned methods, the piles made using these methods cannot improve their ability to transfer from the upper side bending moments or horizontal loads better than a regular pile having the subsequent diameter over its entire length.

This invention is solving the technical issue of shortening construction time and reduction of amount of resources used for construction of a cast in-situ pile having an upper section with a larger diameter and at least one subsequent section with a smaller diameter, such a pile being able to efficiently transfer bending moments and horizontal loads transmitted by the superstructure to the ground.

Also this invention is solving the issue of technical means used to allow CFA method to be applied as technology to construct a cast in-situ pile with an upper section having a large diameter and at least one subsequent section having a smaller diameter, using one drilling rig that will perform the execution in a single penetration stage for all drilling tools used in the process.

This invention is consisting in a construction method for a cast in-situ pile having an upper section with a larger diameter and at least one subsequent section with a smaller diameter, having following operations:

- Insertion of a continuous flight auger with the smaller diameter throughout another drilling tool similar to a continuous flight auger with the bigger diameter and having a hollow stem large enough to accommodate the first drilling auger (hereon named bigger diameter tool);
- Coupling of the bigger diameter tool to the smaller diameter continuous flight auger (hereon named smaller diameter tool), in a predetermined position along the length of the latter mentioned auger, by use of a coupling-decoupling device.
- The entire assembly, composed by the large diameter tool and the smaller diameter tool, is operated by a piling rig and inserted into the ground until the tip of the larger diameter tool is reaching the required depth for the corresponding diameter and length of the pile upper section.
- Decoupling of the bigger diameter tool from the smaller diameter tool, by use of the coupling-decoupling device;
- Further insertion of the smaller diameter tool into the ground until reaching calculated depth for the corresponding pile diameter or final design depth or until penetration is no more possible due to soil layer stiffness;
- Pumping of fresh concrete, or grout or mortar through the hollow stem of the smaller diameter tool while retracting the smaller diameter tool in such way that displaced soil is immediately replaced by the concrete or grout or mortar, until tip of the smaller diameter tool is reaching toe level of the bigger diameter device, thus completing the body length of smaller diameter;
- Coupling of the bigger diameter tool to the smaller diameter tool, by use of the coupling-decoupling device;
- Further extraction of the entire assembly, composed by the large diameter tool and the smaller diameter tool, while continuously pumping concrete or grout or mortar in such way that displaced soil is immediately replaced by the concrete or grout or mortar, until designed level is reached, forming thus the large diameter section of the pile.
- Stoppage of the pumping process and further extraction of the aforementioned drilling assembly until complete extraction from soil.

Also, this invention is referring to a drilling device and assembly used for continuous flight auger drilling method of execution of a cast in-situ pile, having an upper segment with a bigger diameter and at least one following segment below, having a smaller diameter than the upper segment diameter, the drilling device having the diameter equal to the upper segment of the pile and having a hollow stem allowing the accommodation free passing through of at least one drilling tool with a diameter equal to the smaller diameter of the following pile segment, and being equipped with a coupling-decoupling device that allows to compose all drilling devices into a wholly fixed assembly that is operated by the drilling rig.

Another variant of the drilling assembly according to this invention is accommodation of at least another auger with continuous flights with a smaller diameter. This variant would allow application of the construction method described above for construction of a telescopic pile having more than two diameters along its length, decreasing with depth.

This invention has following advantages:

- Construction method and drilling tool assembly according to this invention can be used successfully for installation of cast in-situ piles having at least two segments with different diameters, using a continuous single process of insertion into the ground of each drilling tool needed to shape the pile.
- Drilling assembly that follows similar rules of continuous flight drilling allows faster drilling time, with reduced amount of necessary energy and raw materials and to deeper levels for large diameter.
- Concreting process is performed in a single stage, through the hollow stem inside the smaller diameter tool.

By having a longer upper segment with the larger diameter is possible to efficiently take over bending moments and horizontal loads transmitted by superstructures.

Drilling assembly with continuous flights can be discharged of excavated soil more rapidly and more efficiently compared to drilling buckets used for enlargement of pile heads.

Drilling assembly with continuous flights is easier to build because does not have moving parts such as hinged bottoms or caps, does not need vent openings or opening mechanisms, compared to regular drilling buckets used to enlarge piles head diameter.

Drilling assembly with continuous flights is more relible in operation, having a smaller number of components compared to regular drilling buckets used to enlarge piles head diameter, which are composed by mobile parts that are in direct contact with excavated material and are subjected to more wear and tear.

Coupling-decoupling device allows to fix the larger diameter tool onto the smaller diameter tool at any given position between them, leading to the possibility to construct, without any other alteration of the involved parts, cast in-situ piles having various toe levels bul also various lengths for the upper segments; this possibility to adapt on-the-fly the depths and lengths of the pile segments to further refine the particular geometric parameters of each pile improves the economical aspects because different piles are often loaded with different loads, and sometimes even the good bearing layer might vary over the surface of a structure footprint, and adapting the lengths of each pile will reduce execution time and material consumption.

Figure 2:
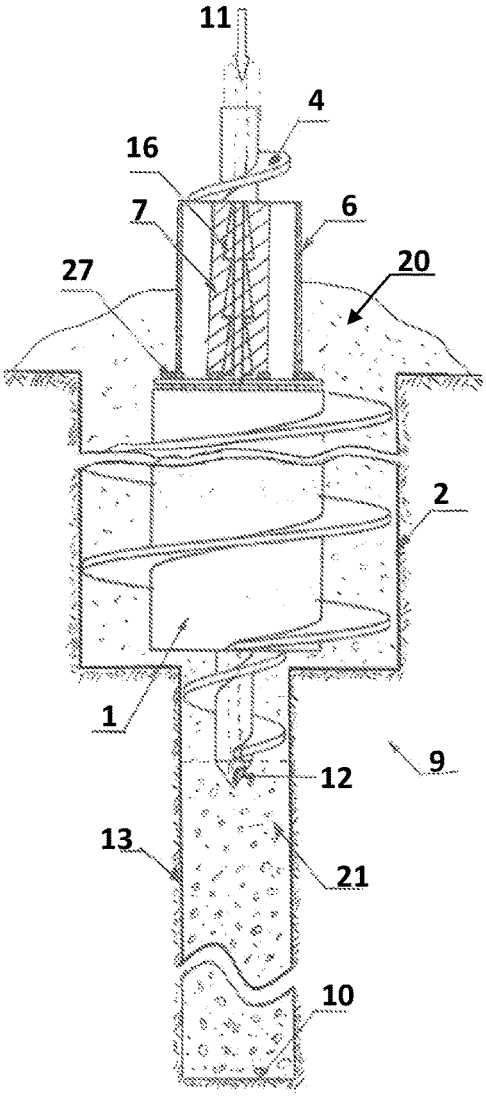
Figure 3:
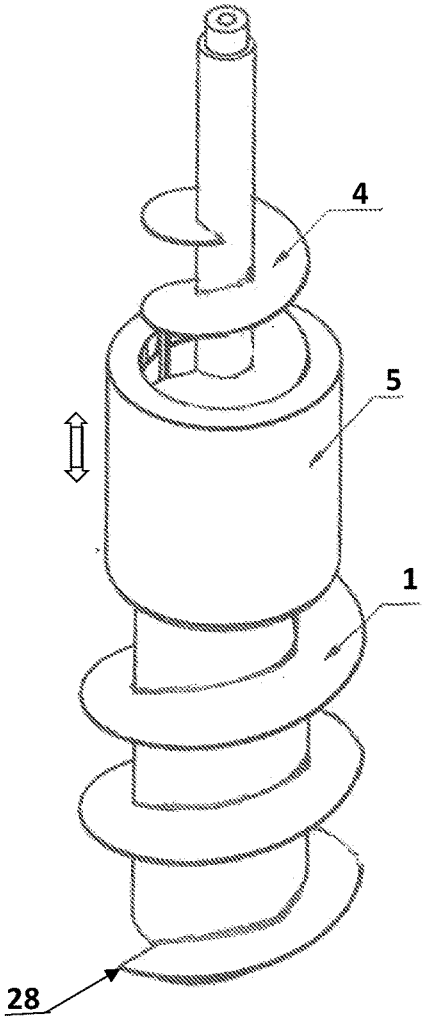
Figure 4:
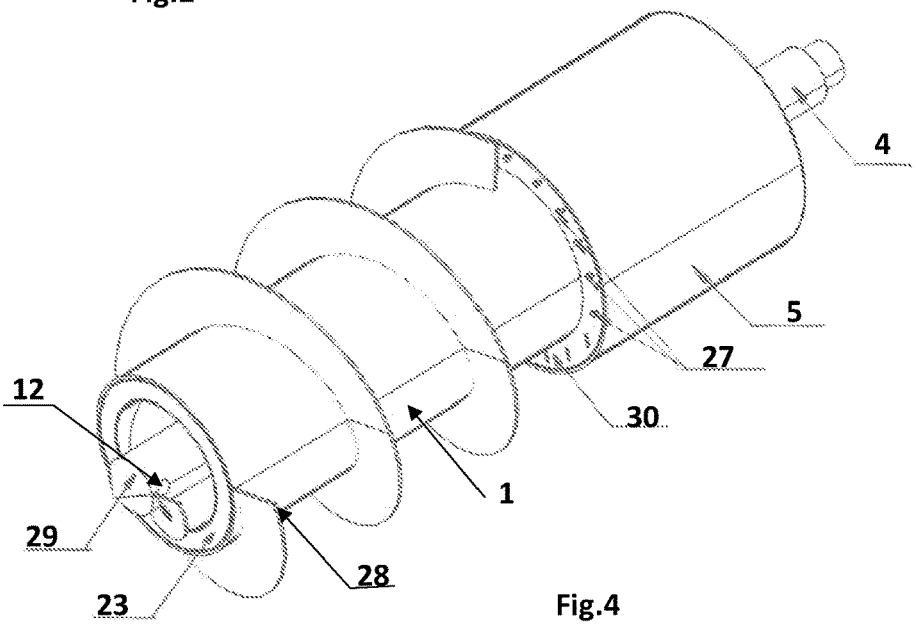
Figure 5:
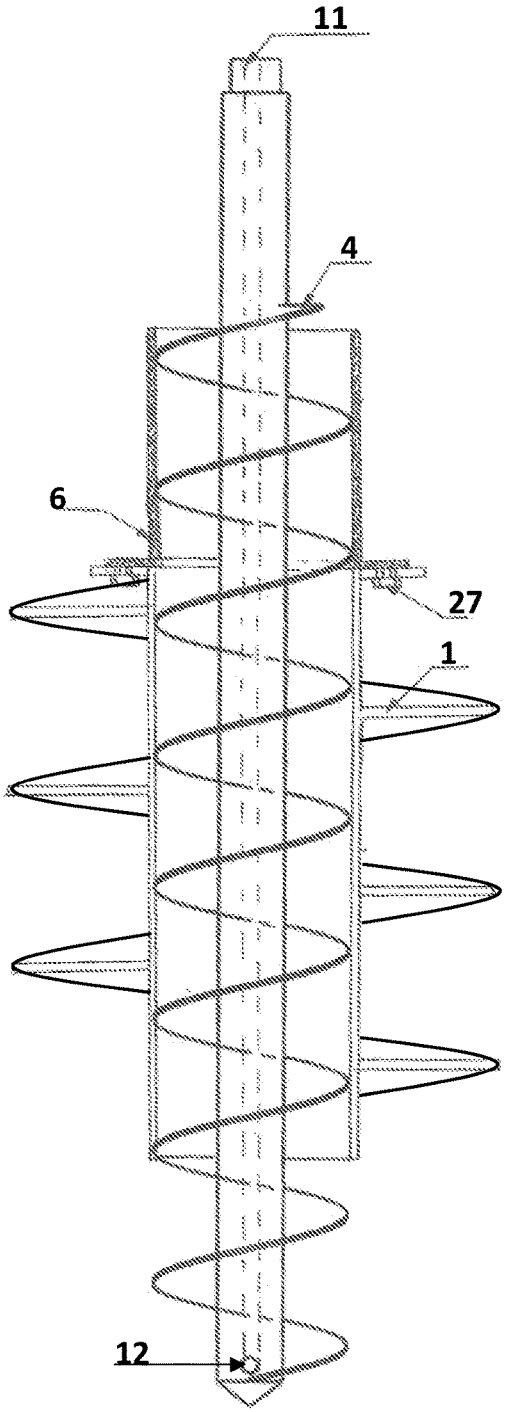
Figure 6:
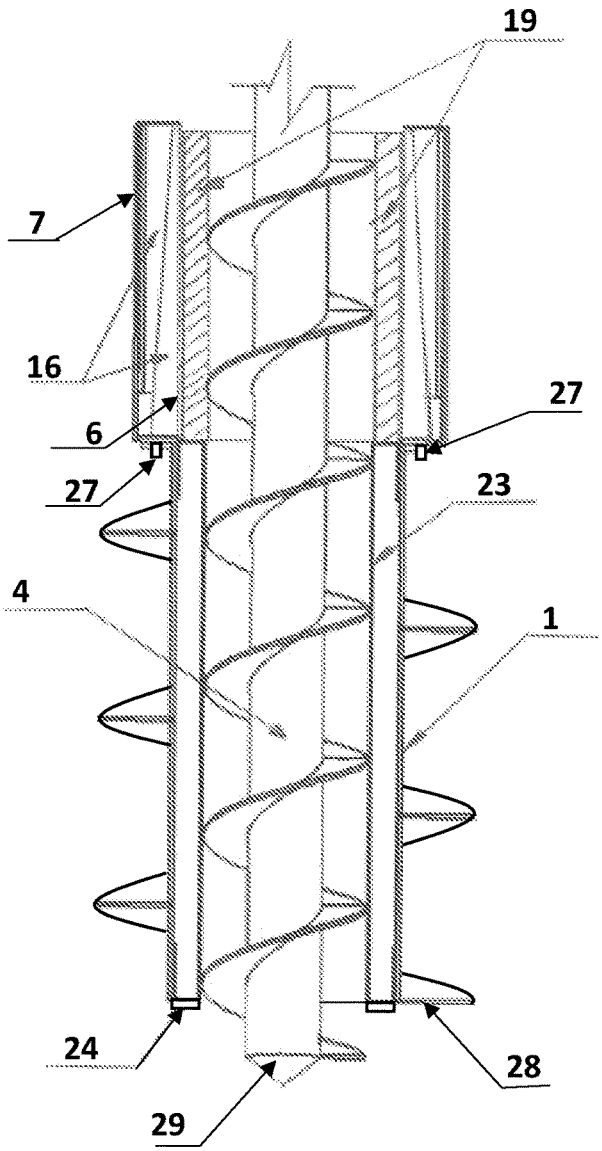
Figure 7:
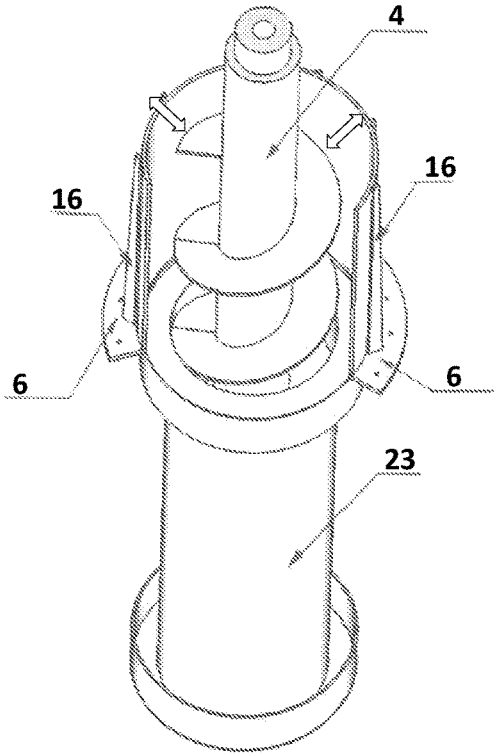
Figure 8:
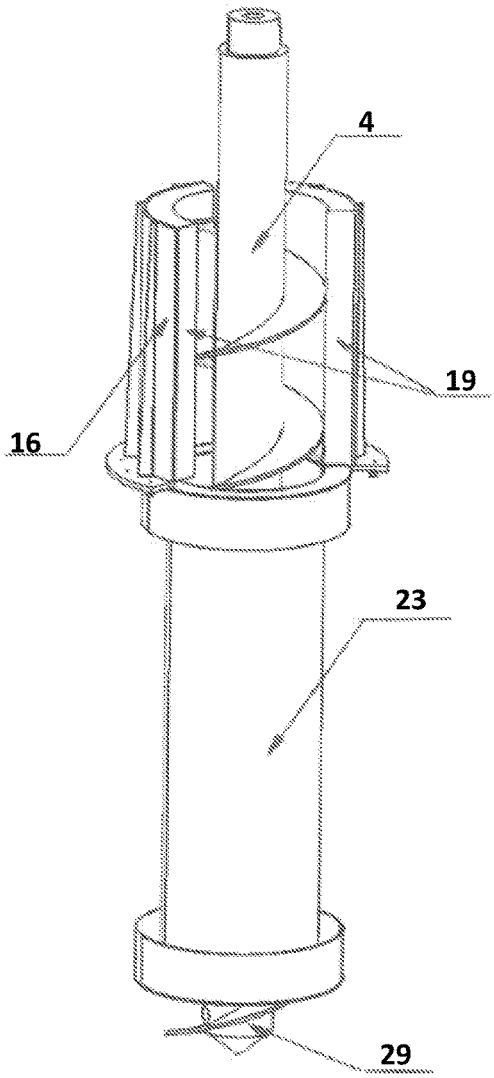
Figure 9:
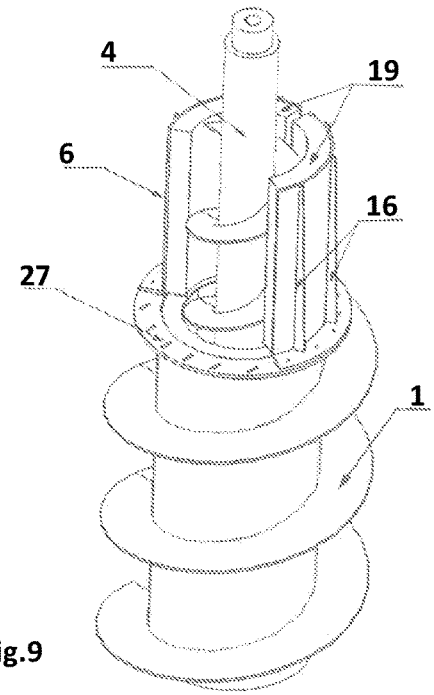
Figure 10:
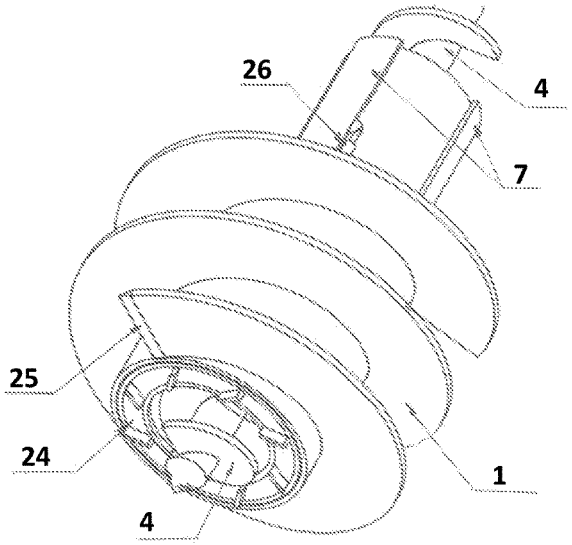
Figure 11:
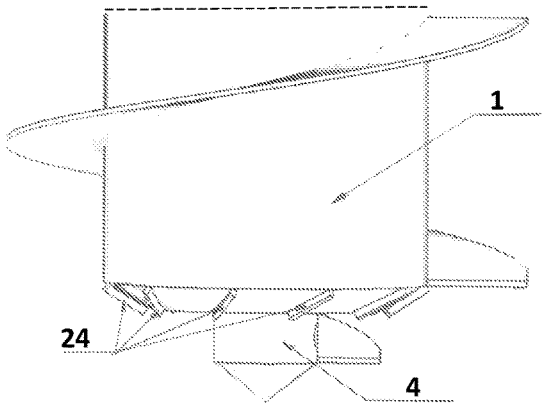

The invention is described below, with reference to following figures:

FIG. 1—Schematic representation of the construction method of cast in-situ piles with diameters decreasing in depth, by a continuous single phase process consisting in a single insertion into the ground of each drilling tool needed to construct the pile;

FIG. 2—Schematic representation of the concreting process for cast in-situ piles with diameters decreasing in depth;

FIG. 3—Example of axonometric view of the large diameter drilling tool connected to a smaller diameter continuous flight auger;

FIG. 4—Example of axonometric view of the large diameter drilling tool connected to a smaller diameter continuous flight auger, with exemplification of a centering spacer between the large diameter tool and the smaller diameter continuous flight auger which can have a diameter smaller than diameter of the hollow stem of the large diameter drilling tool;

FIG. 5—Example of cross section of the large diameter drilling tool, when the diameter of the continuous flight auger is same with diameter of the hollow stem of the large diameter drilling tool;

FIG. 6—Example of cross section of the large diameter drilling tool, when the diameter of the continuous flight auger is smaller than diameter of the hollow stem of the large diameter drilling tool;

FIG. 7—Example of axonometric view of the large diameter drilling tool and of the spacer between the continuous flight auger with smaller diameter and the large diameter drilling tool, with exemplification of blocking pads corresponding to continuous flight auger with a smaller diameter than of the hollow stem of large diameter drilling tool;

FIG. 8—Example of axonometric view of the continuous flight auger with smaller diameter, with exemplification of blocking pads, of spacer between the continuous flight auger with smaller diameter and the large diameter drilling tool, and of the spacers used for the blocking pads of the coupling-decoupling device;

FIG. 9—Example of axonometric view of the large diameter drilling tool, with exemplification of shape of the spacer used on the upper segment of the large diameter drilling tool;

FIG. 10—Example of axonometric view of the tip of the large diameter drilling tool, with exemplification of teeth position on the circular spacer placed between the large diameter drilling tool and smaller diameter drilling tool;

FIG. 11—Example of front view of the tip of the large diameter drilling tool, with exemplification of teeth position or other means to advance through excavated material.

Figure 12:
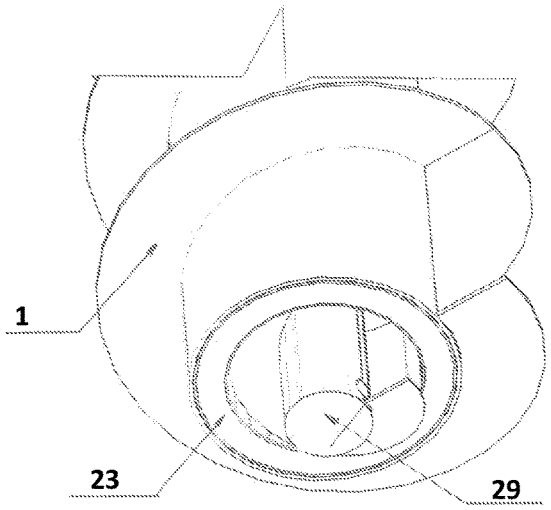
Figure 13:
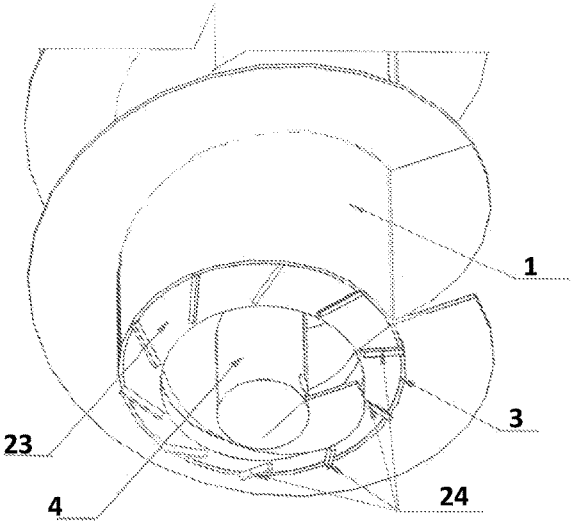
Figure 14:
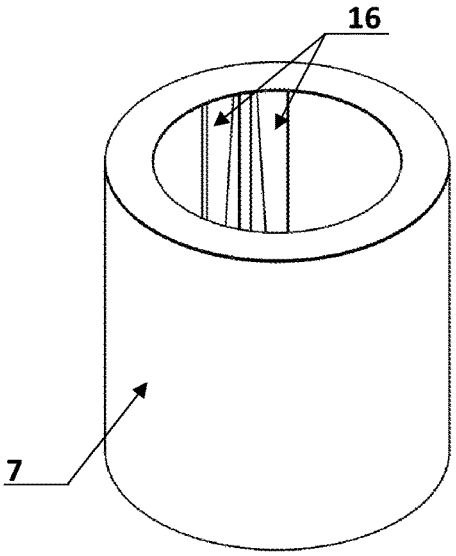
Figure 15:
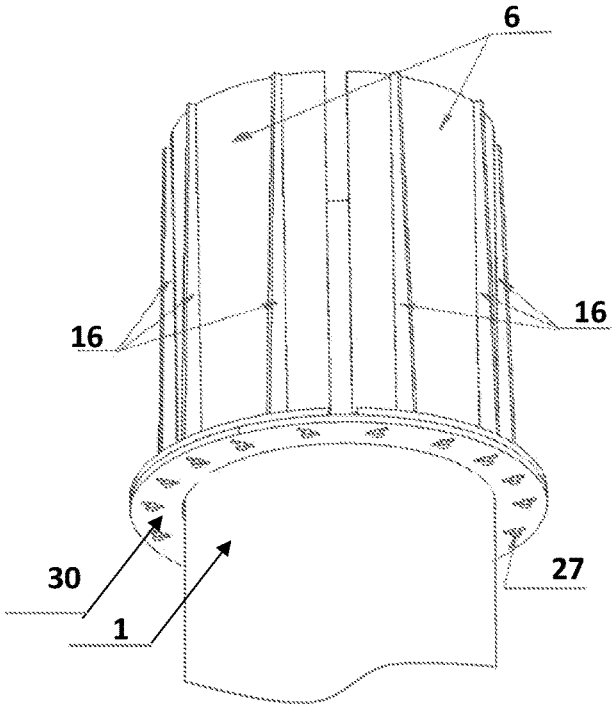
Figure 16:
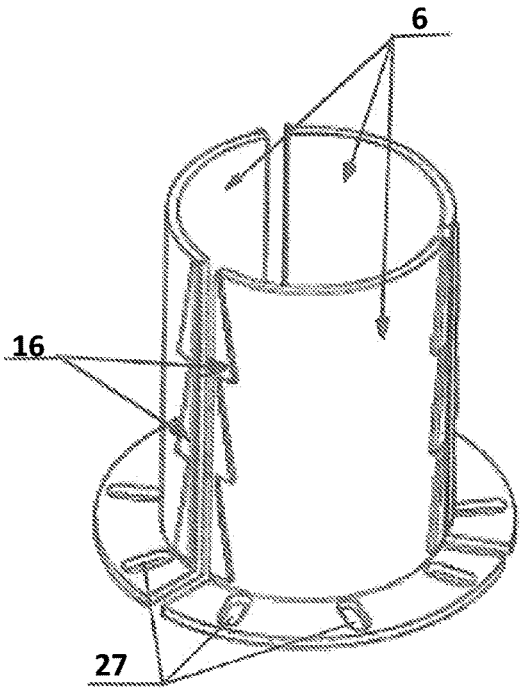
Figure 17:
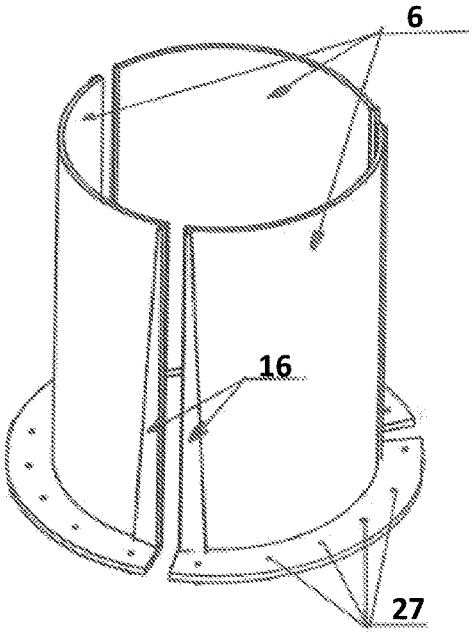
Figure 18:
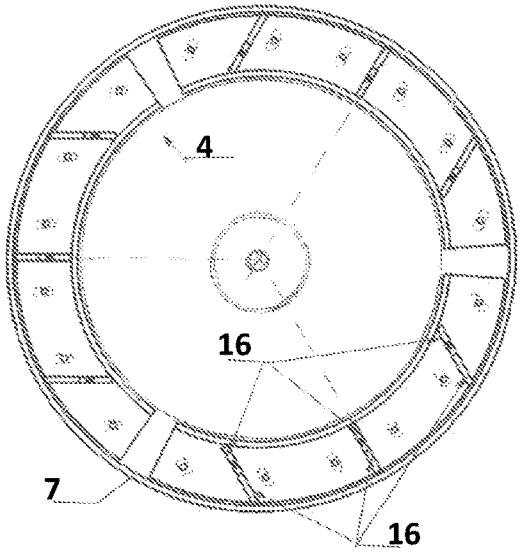
Figure 19:
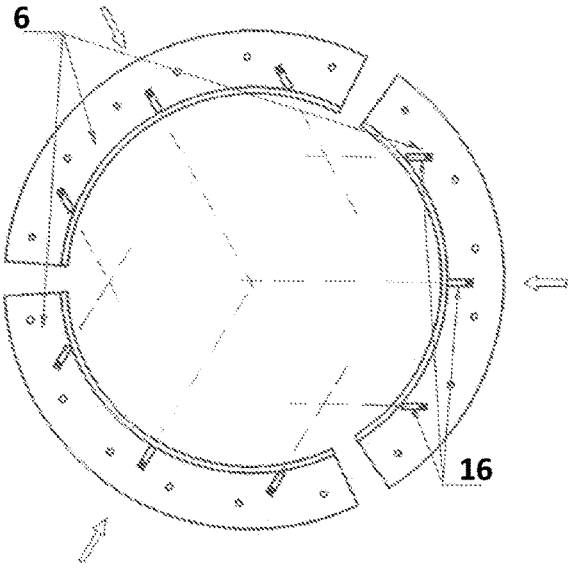
Figure 20:
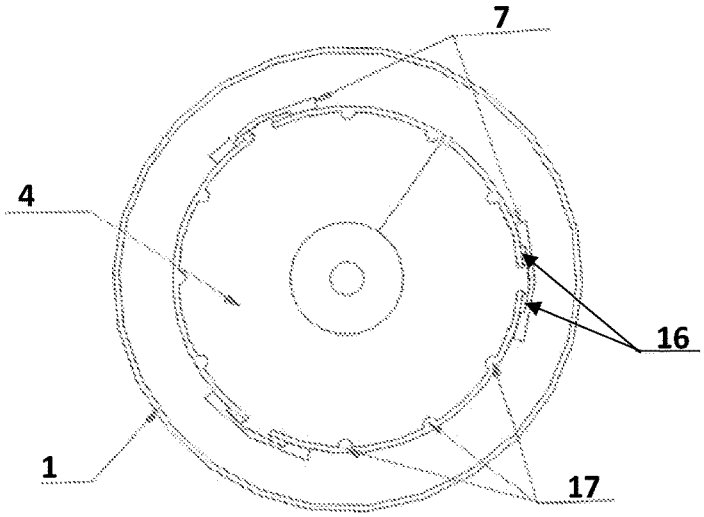
Figure 21:
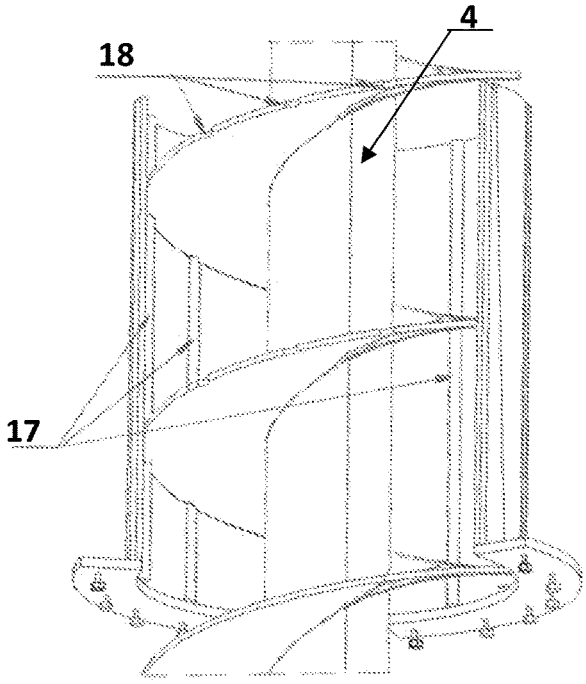
Figure 22:
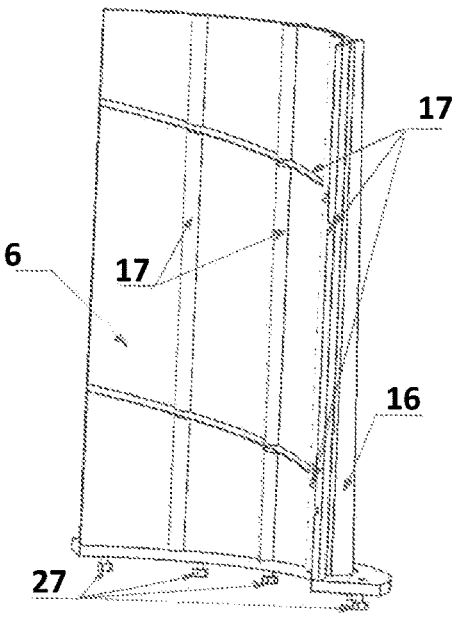
Figure 23:
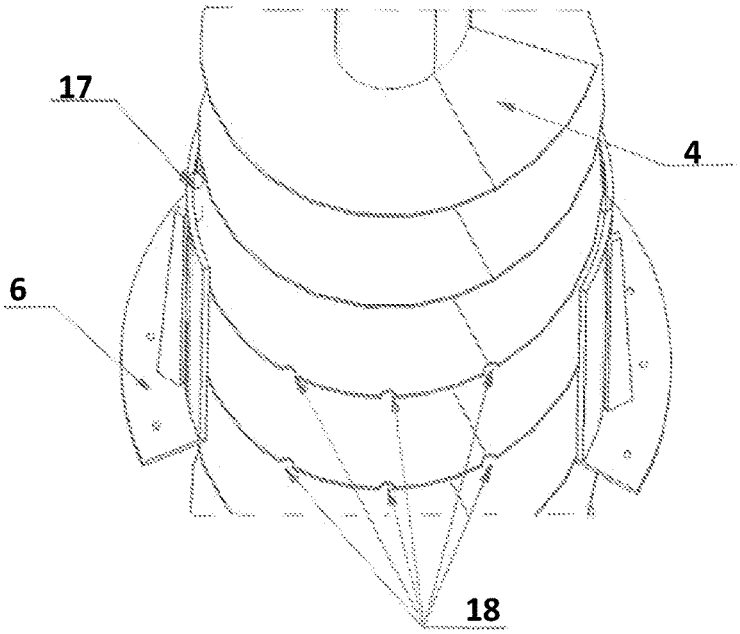

FIG. 12—Example of axonometric view of the tip of the large diameter drilling tool, with exemplification of spacer shape on its lower part;

FIG. 13—Example of axonometric view of the tip of the large diameter drilling tool, with exemplification of teeth position;

FIG. 14—Example of axonometric view of the coupling-decoupling device, with the jaws acting on the blocking pads by directional movement in vertical plan;

FIG. 15—Example of shape of the blocking pads, with an example of shape of clamping wedges which are placed parallel to the movement direction of the blocking pads;

FIG. 16—Example of shape of the blocking pads, with example of multiple clamping wedges having a tangential movement direction to the transversal circular cross section of the smaller diameter drilling tool;

FIG. 17—Example of shape of the blocking pads, with example of shape of clamping wedges having a tangential movement direction to the transversal circular cross section of the smaller diameter drilling tool;

FIG. 18—Example of cross section through the coupling-decoupling device fixed onto the larger diameter drilling tool as per FIG. 3;

FIG. 19—Example of cross section through the blocking pads depicted in FIG. 15;

FIG. 18—Example of cross section through the coupling-decoupling device fixed onto smaller diameter drilling tool, as per FIG. 10;

FIG. 21—Example of position and shape of interlocking strips blocking movement between coupling-decoupling device and smaller diameter drilling tool;

FIG. 22—Example of position and shape of interlocking indents on the blocking pads, blocking movement between coupling-decoupling device and smaller diameter drilling tool;

FIG. 23—Example of position and shape of interlocking indents on the smaller diameter drilling tool flights;

Numerical references marked in the above listed figures are corresponding to following technical items:

1. Large diameter drilling tool;
2. Large diameter drilled shaft;
3. Hollow stem inside the large diameter drilling tool;
4. Continuous flight auger or smaller diameter drilling tool;
5. Coupling-decoupling device;
6. Blocking pads used to fix the large diameter drilling tool onto the smaller diameter drilling tool;
7. Driving mandrel for the blocking pads, having tubular shape or clamping profiled shape;
8. Piling rig;
9. Foundation ground;

10. Pile toe;
11. Concrete hose connected to concrete pump;
12. Concrete nozzle for evacuation of concrete through the hollow stem inside the smaller diameter drilling tool;
13. Pile segment having a smaller diameter;
14. Pile segment having a larger diameter;
15. Kelly extension commonly used for construction of piles by CFA method or densification method;
16. Clamping wedges used in the coupling-decoupling device used to fix connection of the larger diameter drilling tool onto the smaller diameter drilling tool; (assembly of mandrel exterior and blocking pads);
17. Locking rugged surfaces onto inner side of the blocking pads, such as grooves, indentations, striations or ribs;
18. Complementary interlocking rugged surfaces onto the smaller diameter drilling tool, to snugly fit the rugged surfaces onto inner side of the blocking pads, such as grooves, indentations, striations or ribs;
19. Spacers for the blocking pads to compensate the difference in the diameter of the smaller diameter drilling tool and hollow stem space 3 inside the larger diameter drilling tool;
20. Excavated material from drilled shaft;
21. Concrete pumped through the nozzle of the continuous flight auger;
22. Working platform;
23. Spacer used to compensate and center a smaller diameter drilling tool inside a larger hollow stem of the larger diameter drilling tool;
24. Drilling teeth or other profiled shapes placed on the bottom of the centaring spacer 23 having the scope of transferring drilled soil to the flights of the augers;
25. Drilling teeth or other profiled shapes placed on the bottom of the large diameter drilling tool having the scope of transferring drilled soil to the flights of the augers;
26. Device, driven by mechanical, electro-mechanical, hydraulic or electro-hydraulic means, designed to control movement and clamping force of the blocking pads (16) in such way that mandrel (7) will control coupling or decoupling of the larger diameter drilling tool (1) to the smaller diameter drilling tool (4);
27. Means of controlling directional sliding of blocking pads towards or outwards the larger diameter drilling tool (1);
28. Bottom tip of the larger diameter drilling tool;
29. Bottom tip of the smaller diameter drilling tool;
30. Fixed flange onto the upper part of the larger diameter drilling tool (1).

According to this invention, the drilling assembly depicted in FIG. 2 and following FIGS. 3 to 13 is consisting of a large diameter drilling tool (1) with exterior shape similar to a continuous flight auger, having the outer diameter equal to the diameter of the large diameter drilled shaft (2), having a central hollow stem (3) where another smaller diameter drilling tool (4) can translate and rotate independently, having a coupling-decoupling device (5) fixed to it.

The smaller diameter continuous drilling tool (4) can be a commonly used continuous flight auger (CFA) or a tube having a densification barrel or a tube having a regular flight auger of a certain length or a flight auger of a certain length and special shape of the flights with interlocking strips or grooves.

The coupling-decoupling device (5) can have various technical principles, in one of the variants being made as an assembly with metallic wedges (16), so that by hydraulic jacks or mechanic or electro-mechanic gears these can be pushed with significant force that will ensure enclenching of the blocking pads (6) onto the smaller diameter tool (4) in such way that the connection is fixed and impede movement between the parts and can transfer the push force and torque transmitted by the drilling rig to the smaller diameter tool which, in its turn through the coupling procedure, will transmit these loads to the large diameter tool (1) so that it can penetrate the foundation ground (9).

In FIGS. 1 and 2 can be seen an example of this invention construction where the smaller diameter drilling tool (4) is a regular continuous flight auger used in CFA procedure. In one variant of this invention construction, the coupling-decoupling device (5) is consisting of one external mandrel shell (7) which might be of tubular shape or having a clamping like shape, able to interact with one or more blocking pads (6), an array of metallic wedges (16), a coupling system (26) actioned by hydraulic, mechanical or electro-mechanical energy and gliders (26) to ensure directional sliding of the blocking pads (6) against the larger diameter drilling tool (1).

The blocking pads (6) ensure a snugly fixed coupling between the larger diameter drilling tool (1) with the smaller diameter drilling tool (4). The mandrel (7) will interact with the blocking pads (6) by use of a mechanical, electro-mechanical or hydraulic system which is acting on the metallic wedges (16) so that the mandrel (7) is pushing or retracting the blocking pads (6) so that the coupling or decoupling of the larger diameter drilling tool (1) to the smaller diameter drilling tool (4) is made. During drilling process, the large diameter section (2) of a shaft is made when the larger diameter drilling tool (1) is rotated together with the smaller diameter drilling tool (4), connection of the two being fixed by the blocking pads (6) of the coupling-decoupling device (5) which are pushing towards the smaller diameter drilling tool (4) so that friction force developed in between the contact surfaces overcomes the torque amount which is driving the rotational movement of the latter. The smaller diameter drilling tool is pushed downwards and rotated by the hydraulic head of the drilling rig (8). To enhance the friction forces developed by fastening of the blocking pads (6) onto the smaller diameter drilling tool (4), the inner side of the pads (6), as a construction variant, might be particularly profiled (17), with grooves, indentations, striations or ribs. Similarly the smaller diameter drilling tool (4) can have complementary profiles (18), such as grooves, indentations, striations or ribs, made over the contact area between it and the blocking pads (6). This way the connection between the drilling tools is improved and transmission of push force, retraction force or torque to the larger diameter drilling tool (1) is more reliable.

In one construction example, the gliding system (27) that allows fastening or unfastening of the blocking pads (6) onto the smaller diameter drilling tool (4) is made by an array of flange segments, each welded to the lower side of one pad, connected to a fixed flange (30) which is locked to the upper part of the larger diameter drilling tool (1). The connection in this example allows gliding of the flange segment over the fixed flange in a radial direction with bolts or screws inserted in oval openings. Locking or unlocking of movement between the parts is achieved by fastening or unfastening the pads (6) onto the smaller diameter drilling tool (4).

In one construction example, the coupling-decoupling device (5) is locking in a way that allows only the torque to be transmitted to the larger diameter drilling tool during execution of the large diameter segment of the pile shaft, without transmitting push force. In this way the smaller drilling tool (4) can rotate without penetration and excavated soil will not be compressed or transported excessively from the smaller diameter due to different rates of penetration in between the drilling tools. The coupling-decoupling device (5) can be triggered whenever desired to lock rotational movement between larger diameter drilling tool (1) and smaller diameter drilling tool (4), latest stage being when the drilling tip (29) of the smaller diameter drilling tool (4) is retracted to the same level as the cutting edge of the larger diameter drilling tool (1), and lastly the complete drilling assembly is extracted from the borehole.

In one construction example, the coupling-decoupling device (5) has an embedded geared system that allows the larger diameter drilling tool (1) to be driven at a different rotational speed and rotating in same direction or otherwise compared to the rotational speed and rotation direction of the smaller diameter drilling tool (4). This will allow a faster penetration rate of the assembly made by the locked drilling tools (1) and (4) with a smaller amount of energy, in different kinds of soils.

After the larger diameter drilling tool (1) has reached its predetermined depth in the foundation ground (9) where the pile shaft (2) is made, the tool (1) is decoupled from tool (4) by unlocking the coupling-decoupling device (5) and the movement of tool (4) remains independent from tool (4) while tool (4) remains fixed into the ground. Subsequently the drilling process continues following the general rules of drilling by continuous flight auger method or densification method, where smaller diameter drilling tool (4) is further penetrating the foundation ground (9), driven by the drilling rig (8) until the pile toe level (10) is reached. Then starts concrete pumping through the hose (11) coming from concrete pump, and through the hollow stem of the continuous flight auger drilling tool (4), while simultaneously retracting the auger (4) so that displaced soil is replaced by fresh concrete poured inside the pile shaft through the nozzle (12) positioned at the tip of the auger (4). Extraction of the smaller diameter drilling tool (4) can be accompanied by a rotational movement of the tool (4). The process continues until the tip of the drilling tool (4) reaches the cutting edge (28) level of the larger diameter drilling tool (1) which was left previously at a chosen depth for the construction of the pile shaft (2). Hence concludes the concreting operation of the smaller diameter section (13) of the pile. Next, unlike any other method known before, by operating the coupling-decoupling device (5) so that movement is blocked between the drilling tools and can allow the complete fixed assembly composed of larger diameter drilling tool (1), smaller diameter drilling tool (4) and coupling-decoupling device (5) to be extracted from the borehole until a predetermined level is reached, while continuing the concreting procedure as described above, completing the upper segment (14) with a larger diameter of the pile body. Next, according to design calculations, the pile with decreasing diameters in depth can be reinforced with a reinforcement cage capable to withstand necessary amount of loads that the pile is intended to transfer from the superstructure to the ground. Reinforcement can be made of various raw materials such as steel or other metals, carbon or glass fibers, or polymers, or any other. Reinforcement can be shaped as arrays or cages of single bars or clusters of bars, cables or thrust, profiled shapes, or dispersed fibers, or any other shape. The reinforcement can be over the entire length of the pile or partial, either to each or any of the pile sections, in any ratio. Reinforcement can be tensioned before or after the pile was finished, or not tensioned.

The piles made by use of this invention can have empty spaces, connectors to the superstructure elements, precast embedded parts, or embedded parts of any sort, made of any material. To improve settlement behavior of pile and its bearing capacity and inner strength, the piles made using this invention can be grout injected in the base and/or on the shaft. The piles made using this invention can also embed coupling rods to poles or otherwise, as depicted in document RO132489A2, or with a cavitation on the upper side as per patent pending a2017/00041.

In another example of this invention, the smaller diameter drilling tool (4) is a drilling rod equipped with a densification barrel which can have on its bottom an auger of a certain length. The method described with this invention is applied in the same way for this drilling tool, only that the penetration into the ground of the drilling tool (4) is made following the rules of densification displacement techniques generally available for execution of piles.

Advantage for this variant is that by densification of the surrounding soil the pile has a bigger load capacity and improved stiffness, supporting higher axial and horizontal loads as well as a higher bending capacity. Limitations of this method are same as for known methods to install cast in-situ piles using densification process, respectively diameters are limited usually to approximately 700 mm, the maximum value being dependent on the soil state of compaction that might require a higher torque and/or pushing force than is possible to attain with existing technology for pile drilling rigs.

In another example of this invention, the smaller diameter drilling tool (4) is a drilling rod equipped with a densification barrel which can have on its bottom an auger with external fenders or ribs that can imprint notches or grooves into the pile body during concreting phase. The execution method of this invention is applied as described above, except that the penetration into the ground of the drilling tool (4) is made following the rules of densification displacement techniques generally available for execution of screwed piles.

Advantage for this variant is that by densification of the surrounding soil the pile and the body having a screw-like shape has a bigger load capacity and improved stiffness, supporting higher axial and horizontal loads as well as a higher bending capacity. Limitations of this method are same as for known methods to install cast in-situ piles using densification process, respectively diameters are limited usually to approximately 700 mm, the maximum value being dependent on the soil state of compaction that might require a higher torque and/or pushing force than is possible to attain with existing technology for pile drilling rigs.

In another example of this invention, the larger diameter drilling tool (1) is accommodating in its hollow center (3) a second large diameter drilling tool (1) that according to this invention is a "auger in auger" drilling assembly, which in its turn can be connected with a smaller diameter drilling tool (4).

This "auger in auger" assembly allows construction of a pile having three different diameters, decreasing along pile length and depth, the drilling tools being able to be coupled or decoupled independently one to another.

The construction method according to this invention is applied in a similar way as described above, using firstly the assembly "auger in auger" to drill the biggest and upper diameter of the pile, then continuing only with the middle drilling tool type (1) connected to the tool (4) to make the intermediate diameter shaft and lastly continuing only with the smaller diameter drilling tool (4) to drill the last section of the pile with smallest diameter.

The invention claimed is:

1. A drilling device with continuous flights for execution of a cast in-situ pile into ground, the cast in-situ pile having a first section having a first diameter and at least one other section disposed below the first section and having a reduced diameter that is smaller than the first diameter, the drilling device comprising a first drilling tool, a second drilling tool, and a coupling-decoupling device;

wherein the first drilling tool comprises an outer diameter that corresponds to the first diameter, and a central continuous hollow space which allows insertion of at least the second drilling tool;

wherein the second drilling tool comprises an outer diameter that corresponds to the at least one other section of the cast in-situ pile having a reduced diameter; and wherein the coupling-decoupling device allows the first drilling tool to be fastened to the second drilling tool in any position over a length of the second drilling tool.

2. The drilling device with continuous flights according to claim 1 wherein the first drilling tool further comprises a central spacer having a tubular shape disposed within the central continuous hollow space to act as a centering device for the second drilling tool within the central continuous hollow space and to allow soil excavated by the second drilling tool to be transported upwards.

3. The drilling device with continuous flights according to claim 2, wherein the outer diameter of the second drilling tool may vary within predetermined boundaries and wherein the central spacer is configured to accommodate the outer diameter of the second drilling tool.

4. The drilling device with continuous flights according to claim 2 wherein the coupling-decoupling device is configured to lock and transmit when coupled only a torque force during drilling phase into the ground of the first drilling tool without transmitting push or pull force, so that the second drilling tool can rotate together with the first drilling tool without compacting or loosening a surrounding soil beneath the first drilling tool while lifting too much soil through its flights due to smaller penetration rate of the first drilling tool; and wherein the coupling-decoupling device is further configured to be operated to fasten the first drilling tool to the second drilling tool (1) at any time and position when rotational assembly of the first drilling tool and the second drilling tools is required and (2) when the drilling device is being retracted from the ground; and wherein the coupling-decoupling device is further configured to operate to unfasten the first drilling tool from the second drilling tool while the second drilling tool is being retracting into the first drilling tool.

5. A drilling device with continuous flights for execution of a cast in-situ pile into ground, the cast in-situ pile having a first section having a first diameter and at least one other section disposed below the first section and having a reduced diameter that is smaller than the first diameter, the drilling device comprising a first drilling tool, a second drilling tool, and a coupling-decoupling device that allows the first drilling tool to be fastened to the second drilling tool, and a gliding system;

wherein the first drilling tool comprises an outer diameter that corresponds to the first diameter, a central continuous hollow space which allows insertion of at least the second drilling tool, a central spacer having a tubular shape disposed within the central continuous hollow space to act as a centering device for the second drilling tool within the central continuous hollow space and to allow soil excavated by the second drilling tool to be transported upwards, and a flange fixed onto an upper portion of the first drilling tool;

wherein the second drilling tool comprises an outer diameter that corresponds to the at least one other section of the cast in-situ pile having a reduced diameter; and wherein the coupling-decoupling device comprises a mandrel having a tubular shape or a clamping profiled shape, an array of metallic wedges, a driving system acting on the array of metallic wedges by hydraulic or mechanical or electro-mechanical force that drives one or more blocking pads to fasten onto the second drilling tool; and wherein the one or more blocking pads are configured to slide through the gliding system over the flange.

6. The drilling device with continuous flights according to claim 5 wherein the coupling-decoupling device further comprises mobile flange segments that are fixed to each of the one or more blocking pads;

wherein the flange of the first drilling tool and the mobile flange segments comprise oval shaped holes through which fastening screws or other coupling devices may be inserted to allow translation of the one or more blocking pads so that the one or more blocking pads can fasten or unfasten onto the second drilling tool and transmit torque and push or pull force to the first drilling tool.

7. The drilling device with continuous flights according to claim 5 wherein the one or more blocking pads comprise a blocking profile having indents or ribs on a side towards the second drilling tool.

8. The drilling device with continuous flights according to claim 7 wherein the second drilling tool further comprises a profile that corresponds to and is configured to engage with the blocking profile of the one or more blocking pads.

9. A drilling device with continuous flights for execution of a cast in-situ pile into ground, the cast in-situ pile having a first section having a first diameter and at least one other section disposed below the first section and having a reduced diameter that is smaller than the first diameter, the drilling device comprising a first drilling tool, a second drilling tool, and a coupling-decoupling device that allows the first drilling tool to be fastened to the second drilling tool;

wherein the first drilling tool comprises an outer diameter that corresponds to the first diameter, a central continuous hollow space which allows insertion of at least the second drilling tool, and a central spacer having a tubular shape disposed within the central continuous hollow space to act as a centering device for the second drilling tool within the central continuous hollow space and to allow soil excavated by the second drilling tool to be transported upwards;

wherein the second drilling tool comprises an outer diameter that corresponds to the at least one other section of the cast in-situ pile having a reduced diameter; and wherein the coupling-decoupling device comprises a geared transmission that allows the drilling device to rotate the first drilling tool at a different speed rate compared to a rotation of the second drilling tool when the first drilling tool and the second drilling tools are coupled together and wherein the rotation of the first drilling tool can be in a same direction or an opposite direction as the rotation of the second drilling tool.

* * * * *